United States Patent [19]

Carter

[11] 4,266,686

[45] May 12, 1981

[54] PAINT CAN ATTACHMENT FOR HOLDING BRUSHES

[76] Inventor: Joseph F. Carter, 567 Tremont St., Rehoboth, Mass. 02967

[21] Appl. No.: 54,164

[22] Filed: Jul. 2, 1979

[51] Int. Cl.[3] ..... B65D 25/20; B65D 43/08; B65B 39/00

[52] U.S. Cl. ..... 220/90; 15/257 R; 211/65; 248/113

[58] Field of Search ..... 15/257 R; 211/65; 248/113; 220/85 R, 90

[56] References Cited

U.S. PATENT DOCUMENTS

| | | | |
|---|---|---|---|
| 1,764,763 | 6/1930 | Stang | 220/90 X |
| 2,436,924 | 3/1948 | Hansen | 15/257 R X |
| 2,460,136 | 1/1949 | Leonard et al. | 248/113 X |
| 2,469,864 | 5/1949 | Craft et al. | 220/90 X |
| 2,498,511 | 2/1950 | Smith | 211/65 |
| 2,542,737 | 2/1951 | Vogel | 220/90 |
| 3,275,187 | 9/1966 | Lamoureaux | 220/90 |
| 3,428,213 | 2/1969 | Stephens | 220/90 |
| 3,550,887 | 12/1970 | Kwiatkowski | 248/113 |
| 3,980,213 | 9/1976 | Ramsay | 220/90 X |
| 4,150,763 | 4/1979 | Simpson | 220/90 |

FOREIGN PATENT DOCUMENTS

| | | | |
|---|---|---|---|
| 725204 | 7/1942 | Fed. Rep. of Germany | 211/65 |

*Primary Examiner*—Edward L. Roberts
*Attorney, Agent, or Firm*—Salter & Michaelson

[57] ABSTRACT

A holder for paintbrushes that is mounted on the rim of an open paint can and supports the brushes in a position of nonuse. The paintbrush holder includes a tray that occupies less than the full dimension of the open top paint can and has a configuration that provides for the dripping of paint accumulated thereon into the interior of the paint can. The brush holder is also provided with clip means that enables the brushes to be securely located on the tray in side-by-side relation in the position of nonuse.

1 Claim, 5 Drawing Figures

PAINT CAN ATTACHMENT FOR HOLDING BRUSHES

BACKGROUND OF THE INVENTION

The present invention relates to a brush supporting attachment as mounted on the open upper end of a paint can or bucket, wherein the brushes are retained on the attachment in an accessible position for use as desired.

In the painting of various surfaces, it is desirable to retain different size brushes in immediate proximity to the paint can, so that if the use of a smaller size brush is necessary, the brush is immediately available and the user does not have to move to another location for obtaining the smaller brush. This can be particularly objectionable if the user is mounted on a ladder and is painting a house and a sash brush is needed for painting window frames. Under such circumstances, it is desirable to not only have a wider brush available for painting large surfaces, but when the smaller brush, such as a sash brush is needed for painting the window frames, the brush should immediately be available, so that the user does not have to descend the ladder on which he may be mounted, or move to another location to obtain the required brush.

Some efforts have been made to provide attachments for a paint can holding brushes in a nonuse position thereon, but in these prior known attachments, only a single brush has been normally accomodated; and in those instances where more than one brush may be accomodated there was no provision for firmly securing the brushes in place so that they would not be inadvertently dislodged from the top of the paint can. Further, not all of the prior known attachments included means for allowing excess paint accumulated thereon to drip into the interior of the paint can, and oftentimes the accumulation of the paint on the attachments resulted in excess paint being retained on the brush even in the position of nonuse.

Some examples of the prior known paint can attachments are illustrated in the following U.S. patents, which represent the best prior art known to applicant: Uhlig U.S. Pat. No. 2,625,299, Brown U.S. Pat. No. 3,019,939, Lamoreaux U.S. Pat. No. 3,275,187, Schnabel U.S. Pat. No. 3,395,828, Kwaitkowski U.S. Pat. No. 3,550,887, Gorrell et al U.S. Pat. No. 3,948,413, Tarnacki U.S. Pat. No. 4,014,453.

SUMMARY OF THE INVENTION

The present invention relates to an attachment for a paint can for supporting one or more brushes in a position of nonuse thereon. The attachment includes a tray that is mounted on the annular lip at the upper end of the paint can and has an overall configuration that occupies less than the entire space of the open top of the paint can to provide for access to the interior of the can. Securing devices are attached to the underside of the tray for mounting the tray on the annular lip of the can, and a brush holder is secured to the tray adjacent to an outer edge thereof. The brush holder includes clips that receive the handles of brushes therein, the bristle portions of the brushes being received on the tray when the brushes are located in the nonuse position thereon. The tray is also formed with a configuration that provides for dripping of any excess paint thereon into the interior of the paint can.

Accordingly, it is an object of the present invention to provide a paint can attachment that is secured to the open top of the paint can for occupying less than the full dimension thereof and that includes a holder for retaining brushes in a position of nonuse thereon.

Other objects, features and advantages of the invention shall become apparent as the description thereof proceeds when considered in connection with the accompanying illustrative drawings.

DESCRIPTION OF THE DRAWING

In the drawing which illustrates the best mode presently contemplated for carrying out the present invention.

DESCRIPTION OF THE INVENTION

Figure 1:
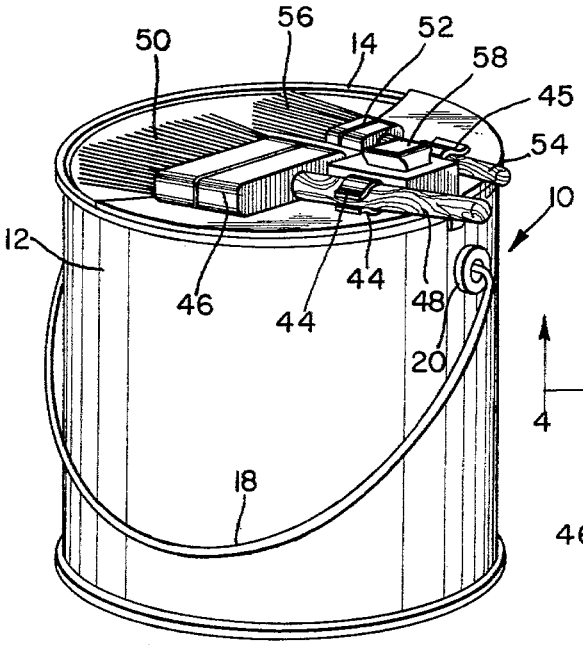
FIG. 1 is a perspective view of a paint can showing the attachment of the present invention mounted thereon, paint brushes being illustrated in the position of nonuse on the attachment.
Figure 4:
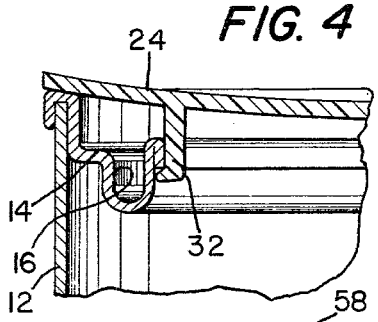
FIG. 4 is a sectional view taken along line 4—4 in FIG. 2.
Figure 5:
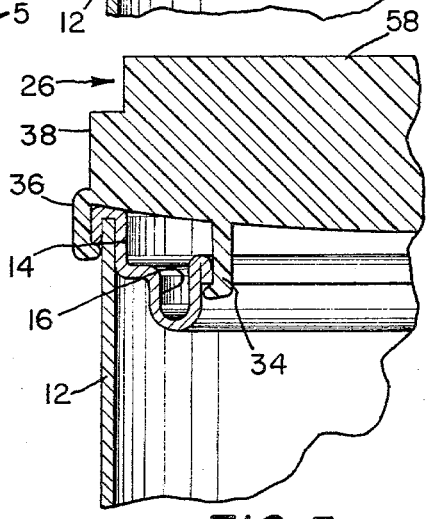
FIG. 5 is a sectional view taken along line 5—5 in FIG. 3.

Referring now to the drawing, and particularly to FIG. 1, a paint can is illustrated and is generally indicated at 10. The paint can 10 which is of a usual construction includes a can body 12 the uppermost end of which includes an annular rim 14. As shown in FIGS. 4 and 5, the annular rim 14 is formed with a conventional groove 16 that receives a downwardly projecting annular bead formed on the underside of the paint can cover for securing the cover to the paint can. A wire bail 18 is fixed in grommets 20 secured to the paint can body 12 in the usual manner.

Figure 2:
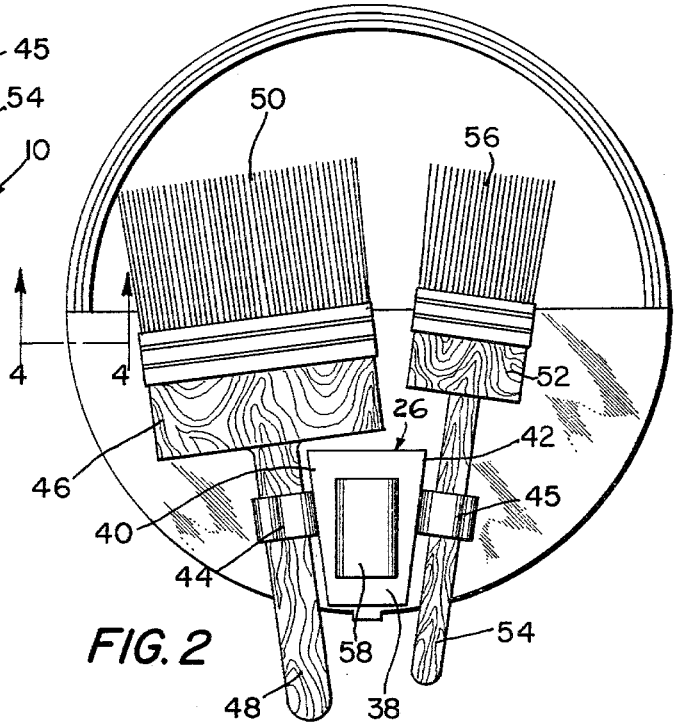
FIG. 2 is a top plan view of the attachment with brushes mounted thereon as illustrated in FIG. 1.
Figure 3:
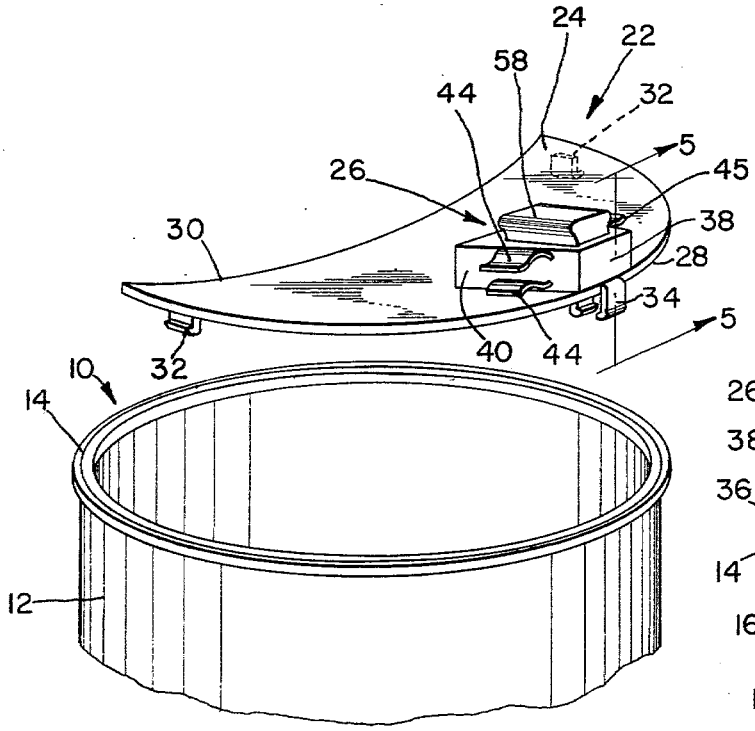
FIG. 3 is an exploded perspective view of the attachment and the top of the paint can.

Referring now to FIG. 3 the brush holder attachment of the present invention is more clearly illustrated and is generally indicated at 22. As shown, the attachment 22 includes a tray 24 on which a holder member generally indicated at 26 is mounted. Preferably the tray 22 and holder member 26 are molded as a single unit from a suitable plastic material that will normally be resistant to wear and will not suffer any deleterious effect upon being exposed to paint. However it is understood, that the holder member 26 may be formed as an independent unit and secured to the upper surface of the tray 24 by any suitable fastening means, such as screws or the like. As shown in FIGS. 2 and 3, the tray 24 is formed in a semi-circular configuration, an upper curved peripheral edge 28 defining the high point of the tray, and the body of the tray 24 being inclined downwardly to the lowermost edge 30 that extends diametrically across the open top of the paint can 10.

In order to secure the attachment 22 to the lip 14 of the paint can 10, opposed clips 32 are provided and are joined to the underside of the tray 24 in spaced relation relative to the peripheral edge 28 thereof as illustrated in FIG. 4. Each of the clips 32 is engageable with an inner wall of the rim 14 as located inwardly of the annular groove 16, and thus the clips 32 cooperate to prevent lateral shifting of the attachment 22 as mounted on the rim 14. A third clip defined by an inner leg 34 and an outer leg 36 is joined to the tray 24 midway beneath the peripheral edge 28 thereon, the legs 34 and 36 straddling the rim 14 to prevent axial shifting of the tray when it is mounted on the rim 14. Although the clips for securing the attachment 22 to the top of the paint can 10 are shown being molded as a part of the tray 24, it is understood that the clips may be independently formed and joined to the underside of the tray by suitable fastening devices. With the clips located as illustrated on the underside of the tray 24, the attachment 22 is conveniently mounted on the rim 14 of the paint can 10 by locating the clips in engagement with the rim 14 as illustrated in FIGS. 4 and 5. In this position the edge 30 extends diametrically across the upper open top of the paint can 10 and leaves at least one-half of the can top exposed that enables a brush to be inserted therein and into the paint carried within the can body 12.

As described the purpose of the attachment 22 is to mount paint brushes thereon in a position of nonuse. In order to accomplish this purpose, the brush holder member 26 is provided, and as illustrated in FIGS. 2 and 3, includes a block 38 formed with inclined side walls 40 and 42 to which spaced clip arms 44 and 45 respectively are joined. The clip arms 44 and 45 have a curved configuration that cooperate to receive a handle of a brush therein for securing the brush in place on the tray 24. As shown in FIG. 2, a large brush 46 that includes a handle 48 and bristles 50 is located on the attachment 22, the handle 48 extending between the arms 44 for releasable securement of the brush to the holder member 26. A smaller brush 52 having a handle 54 and bristles 56 is shown mounted in the position of nonuse on the holder member 26 with the handle 54 located between the clip arms 45 that are joined to the side wall 42 of the holder member.

In order to facilitate removal of the attachment 22 on the rim 14 of the paint can 10 or for placement of the attachment thereon a grip element 58 is provided and is joined to the upper surface of the block 38. The grip element 58 may be formed in any convenient configuration, but as shown is provided with undercut sides that enable the user to firmly grasp the grip element when removing the attachment from the rim 14 or mounting it thereon.

In use, the attachment 22 is mounted in place on the rim 14 of the paint can 10, the location of the lower diametrical edge 30 of the tray 24 providing for sufficient access to the paint carried within the can body 12. Brushes 46 and 52 may be mounted in the position as shown in FIG. 2 when not in use. Preferably, the brush 46 is formed with a relatively wide body and a corresponding width for the bristles 50 that is applicable for painting large surfaces. The smaller brush 52 is fomed with a smaller body and bristle width than the body and bristles of the brush 46 and would normally be used in those places that require a smaller brush, such as on window sashes. The user would normally carry the paint can 10 with the attachment 22 and brushes 46 and 52 mounted thereon by the bail 18 to the location at which he intends to apply the paint. If the user ascends a ladder, it is seen that both brushes 46 and 52 are available for easy access and may be used, depending upon the surface to be painted. In the position of nonuse, either of the brushes is firmly secured in the clips joined to the holder member 26, and with either brush located in the position of nonuse, sufficient space is provided for dipping of the other brush into the paint can during the painting operation.

The diametrical lower edge 30 of the tray 24 also defines a wiping edge for the brushes, and this enables excess paint to be easily returned to the body of the paint can without dripping of the paint along the outer edges of the can or rim. When it is desired to change brushes, depending upon the surface to be painted, the user merely places the handle of the brush to be located in a nonuse position between the appropriate clips on the holder member 26 as shown in FIG. 2, and then withdraws the other brush for use as desired.

When the painting operation has been completed, the attachment 22 is easily removed from the rim 14 of the paint can, and the paint can cover is then inserted over the rim for the covering of the can. In this connection, it is also seen that because the user does not use the rim of the paint can as a wiping surface, the groove 16 does not fill with paint, as is the usual custom, and the rim groove remains relatively clean so that later removal of the can top is easily facilitated when required.

While there is shown and described herein certain specific structure embodying the invention, it will be manifest to those skilled in the art that various moifications and rearrangements of the parts may be made without departing from the spirit and scope of the underlying inventive concept and that the same is not limited to the particular forms herein shown and described except insofar as indicated by the scope of the appended claims.

What is claimed:

1. An attachment for a paint can for supporting one or more brushes thereon, wherein said paint can includes a container body having an open top defined by an annular lip, comprising a tray that is mounted on said annular lip at the upper end of said container body, said tray having an overall configuration that occupies less than the entire space of said open top to provide for access to the interior of said container body, means for removably securing said tray to said annular lip, and a brush holder member secured to said tray adjacent to the outer edge thereof, said brush holder member including clip means for receiving the handle of at least one brush therein, the bristle portion of said brush being received on said tray when the brush is located by said clip means in the nonuse position thereof, and said tray having a conformation that provides that any excess paint deposited thereon from said brush will drain back into the interior of said container, said brush holder member having oppositely inclined side walls to which said clip means is joined, said inclined side walls defining an angle with the horizontal axis of said brush holder member for locating a brush secured to the clip means in an angular relationship relative to said horizontal axis, wherein a pair of brushes may be secured in said clip means in adjacent relation without interference with each other.

* * * * *